United States Patent [19]

Gall et al.

[11] Patent Number: 4,579,397

[45] Date of Patent: Apr. 1, 1986

[54] SEWING MACHINE HEAD LIFT DEVICE

[75] Inventors: John C. Gall, Chicago; Richard D. Meharg, Winfield, both of Ill.

[73] Assignee: Sears, Roebuck & Co., Chicago, Ill.

[21] Appl. No.: 657,505

[22] Filed: Oct. 4, 1984

[51] Int. Cl.[4] ..... A47B 81/00

[52] U.S. Cl. ..... 312/27; 112/217.1; 312/21; 312/30

[58] Field of Search ..... 312/27, 30, 21, 24; 112/217.1, 260

[56] References Cited

U.S. PATENT DOCUMENTS

| | | | |
|---|---|---|---|
| Re. 28,835 | 6/1976 | Roberts et al. | 312/29 |
| 300,684 | 6/1884 | Bolton et al. | 312/28 |
| 553,860 | 2/1896 | Longstaff | 312/25 |
| 779,569 | 1/1905 | Tetreault | 312/30 |
| 1,057,809 | 4/1913 | Diehl et al. | 312/24 |
| 1,122,372 | 12/1914 | Duncan | 312/28 |
| 1,888,034 | 11/1932 | Frankel | 312/28 |
| 2,010,990 | 8/1935 | Hoover | 312/160 |
| 2,247,380 | 7/1941 | Hohmann | 312/30 |
| 2,251,198 | 7/1941 | Oneal | 312/28 |
| 2,318,443 | 5/1943 | West | 312/30 |
| 2,398,696 | 4/1946 | Colegrove | 112/260 |
| 2,402,412 | 6/1946 | Koch | 312/29 |
| 2,409,758 | 10/1946 | Hohmann et al. | 112/260 |
| 2,528,935 | 11/1950 | Williams | 108/62 |
| 2,557,735 | 6/1951 | Fox | 312/28 |
| 2,608,456 | 8/1952 | Barth | 312/8 |
| 2,711,940 | 6/1955 | Hochman | 312/30 |
| 2,738,248 | 3/1956 | Berker | 312/29 |
| 2,766,538 | 10/1956 | Iorio | 40/31 |
| 2,790,690 | 4/1957 | James | 312/30 |

(List continued on next page.)

FOREIGN PATENT DOCUMENTS

| | | |
|---|---|---|
| 143857 | 6/1935 | Austria . |
| 504281 | 7/1928 | Fed. Rep. of Germany . |
| 1809290 | 6/1970 | Fed. Rep. of Germany . |
| 504335 | 12/1954 | Italy . |

OTHER PUBLICATIONS

Heinz, "Optical Transmission Testing Device", *Western Elect. Tech. Digest,* No. 5, 1/67, p. 7.

O'Reilly, "Short Communication", *Optical and Quantum Elect.,* vol. 7, No. 5, 9/75, pp. 425–427.

Huber et al., "Wide-Band Frequency Modulation . . . ", *Applied Optics,* vol. 18, No. 8, 4/79, pp. 1249–1252.

Saito et al., "Optical Heterodyne Detection . . . ", *Elect. Lett.,* vol. 16, No. 22, pp. 826–827.

Kobayashi et al., "Optical Phase Modulation . . . ", *Elect. Lett.,* vol. 18, No. 5, 3/82, pp. 210–211.

*Primary Examiner*—James T. McCall

*Attorney, Agent, or Firm*—Wood, Dalton, Phillips Mason & Rowe

[57] ABSTRACT

A lift device for a sewing machine head of the type having a free arm to alternately provide flat bed, free arm and storage positions in a cabinet having a tabletop with a cutout for the sewing machine head and a pivoting lift mechanism disposed beneath the cutout. The lift device includes a base plate for the sewing machine head secured to the pivoting lift mechanism to permit movement of the sewing machine head between the flat bed, free arm and storage positions. The lift mechanism includes a pair of primary links having first ends pivotally secured to the underside of the tabletop adjacent and on opposite sides of the cutout and a pair of secondary links having first ends pivotally secured at opposite sides of the base plate remote from the points at which the primary links are secured to the tabletop with the second ends of the primary links being pivotally secured to the second ends of the secondary links. The lift device also includes structure in the form of members which engage and disengage in response to movement of the lift mechanism for supporting the sewing machine head in each of the flat bed, free arm and storage positions. By limiting relative pivotal movement between the primary links and the secondary links and between the secondary links and the base plate, the lift device is capable of shifting the center of gravity of the sewing machine head toward the pivot point during movement between the flat bed, free arm and storage positions.

30 Claims, 7 Drawing Figures

U.S. PATENT DOCUMENTS

| | | | |
|---|---|---|---|
| 2,829,020 | 4/1958 | Hutzelman | 312/27 |
| 2,887,350 | 5/1959 | Cotton et al. | 312/29 |
| 2,903,314 | 9/1959 | VanOrdt | 312/29 |
| 3,264,046 | 8/1966 | Preuss | 312/26 |
| 3,765,739 | 10/1973 | Williams | 312/30 |
| 3,788,716 | 1/1974 | Roberts et al. | 312/29 |
| 3,823,993 | 7/1974 | Kakishima | 312/21 |
| 3,830,554 | 8/1974 | Moussaian | 312/30 |
| 3,870,386 | 3/1975 | Shepherd | 312/30 |
| 3,986,755 | 10/1976 | Kohara | 312/21 |
| 4,005,918 | 2/1977 | Smith et al. | 312/27 |
| 4,018,487 | 4/1977 | Orr et al. | 312/27 |
| 4,089,572 | 5/1978 | Flynt et al. | 312/27 |
| 4,089,573 | 5/1978 | Aeschliman | 312/27 |
| 4,108,512 | 8/1978 | White | 312/24 |
| 4,132,454 | 1/1979 | Johnson et al. | 312/27 |
| 4,135,463 | 1/1979 | Lacasse | 112/217.1 |
| 4,183,594 | 1/1980 | Mey et al. | 312/27 |
| 4,194,799 | 3/1980 | White | 312/21 |
| 4,201,427 | 5/1980 | Orr | 312/21 |
| 4,241,961 | 12/1980 | Peterson et al. | 312/22 |
| 4,274,686 | 6/1981 | White | 312/27 |
| 4,473,270 | 9/1984 | Shaw | 350/96.15 |

SEWING MACHINE HEAD LIFT DEVICE

BACKGROUND OF THE INVENTION

The present invention generally relates to a sewing machine lift device and, more particularly, to a lift device to alternately provide flat bed, free arm and storage positions for a sewing machine head of the type having a free arm.

A wide variety of mounting mechanisms for domestic sewing machines which are mounted in cabinets have been proposed in the past. These machines are normally provided with a mounting mechanism which enables the sewing machine to be secured in an upper operating position and also to be lowered into a storage position within the cabinet. In addition, mounting mechanisms for free arm sewing machines provide an additional higher working position to optimize the use of the free arm feature.

Although mounting mechanisms for free arm sewing machines are known, they are often quite complex, difficult to operate, and require heavy lifting. Specifically, such mounting mechanisms commonly consist of rear hinge points about which the sewing machine pivots into the storage position and, in addition, a forward hinged section is commonly provided in the cabinet top for clearance for passage of the head of the sewing machine and also to provide support to hold the machine in the operating position, but the primary disadvantage of this type of system is that the forward hinged section, and the clearances required, necessitate that the working position of the machine is relatively far back from the front of the cabinet. Moreover, moving the sewing machine from the storage position requires lifting much of the head weight of the sewing machine and, importantly, the movement is often in an awkward rearward arc which dictates the need for spring assists or counterbalances.

With the more recent popularity of the free arm sewing machine, the need for a three position lift mechanism has been emphasized. Typical examples of these types of mechanisms can be seen in any of U.S. Pat. Nos. 4,005,918; 4,108,512; 4,132,454; 4,201,427; and 4,274,686. While the primary problem of providing a lift mechanism has been addressed, no one has successfully overcome the recognized disadvantages of such mechanisms.

In order to overcome the problems in this area, the present invention provides a new lift device whose primary objective is to provide two working positions near the front of the cabinet. A further important object is to provide a lift device which inherently shifts the sewing machine center of gravity closer to the pivot point during movement. Another important object is to significantly reduce the force required to move the sewing machine between the various positions without the need for spring assistance. Still another important object is to provide a lift device which can be simply and conveniently shifted between the various positions from a seated operating position. Additional objects will become apparent from a consideration of the details of construction and operation set forth hereinafter.

SUMMARY OF THE INVENTION

The present invention is directed to a sewing machine lift device to alternately provide flat bed, free arm and storage positions for a machine of the type having a free arm. The device is well suited for use with a cabinet which has a tabletop with a cutout for the sewing machine, and the device includes a pivoting lift mechanism adapted to be disposed beneath the cutout. In addition, the device includes a base for the sewing machine secured to the lift mechanism to permit movement of the sewing machine head between the flat bed, free arm and storage positions.

The lift mechanism includes means for shifting the center of gravity of the sewing head toward the pivot point. More specifically, the shifting means includes primary means pivotally secured to the underside of the tabletop and secondary means pivotally secured at the base with the primary means and the secondary means being pivotally secured to one another. The lift mechanism also includes means for limiting relative pivotal movement between the primary means and the secondary means and between the secondary means and the base.

Referring to the invention in greater detail, the base advantageously comprises a base plate on which the sewing machine is to be mounted. It is also contemplated that the center of gravity shifting means shall include a pair or primary links each of which has a first end pivotally secured to the underside of the tabletop adjacent and on opposite sides of the cutout and a pair of secondary links each of which has a first end pivotally secured at opposite sides of the base plate remote from the points at which the primary links are secured to the tabletop, and the secondary links have second ends pivotally secured to the primary links. Moreover, the means for limiting relative pivotal movement between the primary links and the secondary links is preferably a pin and slot arrangement.

In a preferred embodiment, the pin and slot arrangement includes a curved slot with a pin disposed therein. The length of the curved slot determines the limits for relative pivotal movement. Preferably, the pin is provided on the secondary link and the curved slot is provided in the primary link.

Additionally, the base plate is provided with a pair of base brackets on opposite sides thereof and the secondary links have their first ends pivotally secured to the base brackets. The means for limiting relative pivotal movement between the secondary links and the base plate is again a pin and curved slot arrangement with the length of the slot determining the limits for relative pivotal movement. Advantageously, the pin is provided on the secondary link and the curved slot is provided in the base bracket.

Additional details of the preferred embodiment include a pin and latch arrangement comprising the means for supporting the sewing machine in the flat bed position. The pin and latch arrangement preferably includes a pivotable spring biased primary latch having a pin receiving portion with the sewing machine being supported in the flat bed position when the pin is disposed in the pin receiving portion of the primary latch. The primary latch preferably is provided on a mounting bracket on the underside of the tabletop disposed on one side of the cutout with the pin being provided on the primary link for engagement with the primary latch. Additionally, the means for supporting the sewing machine in the free arm position preferably includes a pair of pin and latch arrangements on opposite sides of the cutout.

For support in the free arm position of the sewing machine, the pin and latch arrangements preferably include the primary latches and a pair of pivotable spring biased secondary latches each of which advantageously includes a pin receiving portion. The secondary latches are preferably provided on the primary links with the corresponding pins being provided on the secondary links. With this arrangement, the sewing machine head is supported in the free arm position when the respective pins are disposed in the pin receiving portions of the pairs of primary and secondary latches.

Among other features is a stop in the form of a rigidly mounted block disposed beneath the cutout for supporting the sewing machine head in a storage position at a point remote from the base plate. Also, another stop in the form of a rigidly mounted block is disposed beneath the cutout to limit pivotal movement of the primary link in one direction when the sewing machine head is moved to the storage position.

Other objects, advantages and features of the present invention will be apparent from a consideration of the foregoing details taken in conjunction with the accompanying drawings.

DETAILED DESCRIPTION OF THE PREFERRED EMBODIMENT

Figure 1:
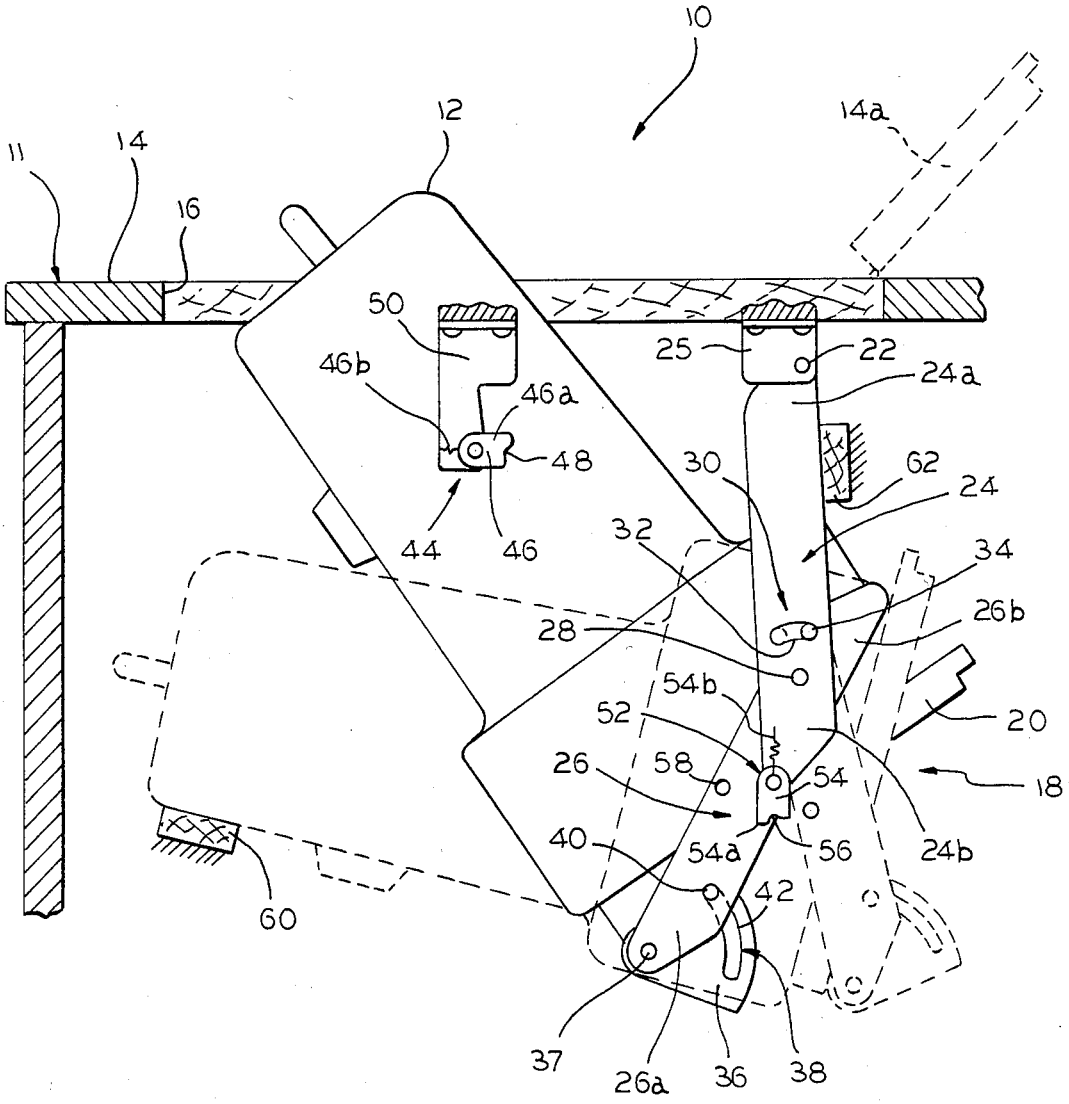
FIG. 1 is a cross sectional view of a sewing machine lift device in accordance with the present invention illustrating a sewing being moved from a storage position.

Referring to FIG. 1, the reference numeral 10 designates generally a sewing machine lift device to alternately provide flat bed, free arm and storage positions for a sewing head 12 of the type having a free arm. The sewing machine lift device 10 includes a cabinet 11 having a tabletop 14 with a cutout 16 for the sewing head 12 and a pivoting lift mechanism 18 disposed beneath the cutout 16. In addition, the sewing machine lift device 10 includes a base 20 for the sewing head 12 secured to the pivoting lift mechanism 18 to permit movement of the sewing head 12 between the flat bed, free arm and storage positions.

The pivoting lift mechanism 18 includes means for shifting the center of gravity of the sewing head 12 toward the pivot point or pin 22. More specifically, the shifting means, which reduces the primary pivot radius and, thus, the moment arm of the sewing head 12, includes primary pivot means or link 24 pivotally secured to the underside of the tabletop 14 by means of a bracket 25 and secondary pivot means or link 26 pivotally secured at the base 20, with the primary pivot means or link 24 and the secondary pivot means or link 26 being pivotally secured to one another for relative movement about the pivot point or pin 28. The pivoting lift mechanism 18 also includes means for limiting relative pivotal movement between the primary secondary pivot means or link 24 and the secondary pivot means or link 26 and between the secondary pivot means or link 26 and the base 20.

As shown in the drawings, the base 20 comprises a base plate on which the sewing head 12 is to be mounted. It will also be appreciated that, in the preferred embodiment, the center of gravity shifting means will actually include a pair of primary links 24 each of which has a first end **24*a* pivotally secured to the underside of the tabletop 14 by means of a corresponding bracket 25 adjacent and on opposite sides of the cutout 16 and a pair of secondary links 26 each of which has a first end 26*a* pivotally secured at opposite sides of the base plate 20 remote from the points at which the primary links 24 are secured to the tabletop 14 and a second end 26*b* pivotally secured to the second end 24*b* of the corresponding secondary link 24. Moreover, the means for limiting relative pivotal movement between each of the pairs of primary links 24 and secondary links 26 is a pin and slot arrangement 30**.

In the preferred embodiment, the pin and slot arrangements 30 each include a curved slot 32 with a pin 34 disposed therein. The length of the curved slot 32 can be a preselected amount to determine the limits for relative pivotal movement. Preferably, the pins 34 are provided on the secondary links 26 and the curved slots 32 are provided in the primary links 24.

Additionally, the base plate 20 is provided with a pair of base brackets 36 on opposite sides thereof and the secondary links 26 have their first ends **26*a* pivotally secured to the base brackets 36 by means of base pivot points or pins 37. The means for limiting relative pivotal movement between each of the secondary links 26 and the base plate 20 is again a pin and curved slot arrangement 38 each of which preferably includes a pin 40 disposed in a curved slot 42 with the length of the slot 42 determining the limits for relative pivotal movement. Advantageously, the pins 40 are provided on the secondary links 26 and the curved slots 42 are provided in the base brackets 36**.

Figure 3:
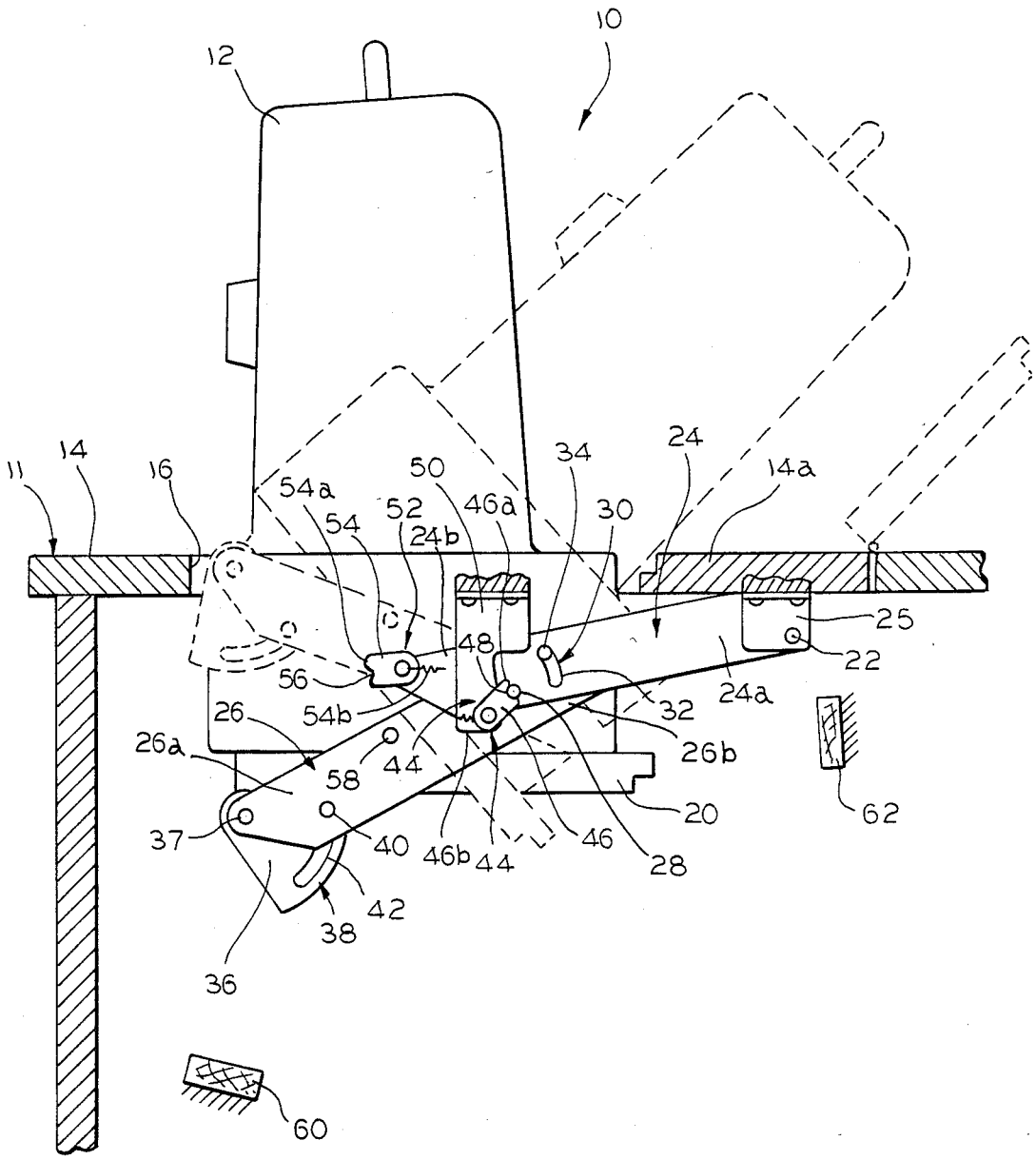
FIG. 3 is a cross sectional view of a sewing machine lift device in accordance with the present invention illustrating a sewing machine being moved to a lower operating position.

Additional details of the preferred embodiment include a pin and latch arrangement 44 comprising the means for supporting the sewing head 12 in the flat bed position (see FIG. 3). The pin and latch arrangement 44 preferably includes a pivotable spring biased primary latch 46 having a pin receiving portion 48, and the sewing head 12 is supported in the flat bed position when the pin 28 is disposed in the pin receiving portion 48 of the primary latch 46. The primary latch 46 preferably is provided on a mounting bracket 50 on the underside of the tabletop 14 disposed on one side of the cutout 16 with the pin 28 being an extension of the pivot point between the primary link 24 and the secondary link 26 for engagement with the primary latch 46. Additionally, the means for supporting the sewing head 12 in the free arm position preferably includes a pair of pin and latch arrangements 44 and 52 (see FIG. 5).

For support in the free arm position of the sewing machine, the pin and latch arrangements 44 and 52 preferably include the pivotable spring biased primary latch 46 and a pivotable spring biased secondary latch 54 each of which advantageously includes a pin receiving portion 48 and 56, respectively. The primary latch 46 is preferably provided on the mounting bracket 50 adjacent the path of travel of the primary and secondary links 24 and 26 and the secondary latch 54 is preferably provided on the primary link 24 with the corresponding pin 58 being provided on the secondary link 26. With this arrangement, the sewing head 12 is supported in the free arm position when the pins 28 and 58 are disposed in the pin receiving portions 48 and 56 of the primary and secondary latches 46 and 54, respectively.

Referring once again to FIG. 1, the sewing machine lift mechanism 10 includes means for supporting the sewing head 12 in the storage position in the form of a stop 60. The stop 60, which is disposed beneath the cutout 16 and secured to the cabinet 11, is a rigidly mounted block for supporting the sewing head 12 at a point remote from the base plate 20. Also, a stop 62 is provided to limit pivotal movement of the primary link 24 in one direction. The stop 62, which is also disposed beneath the cutout 16 and secured to the cabinet 11, is similarly a rigidly mounted block abutted by the primary link 24 when the sewing head 12 is moved to the storage position (shown in phantom lines in FIG. 1). With this construction, the sewing machine head 12 cannot inadvertently be lowered beyond the storage position.

Finally, as discussed in connection with the center of gravity shifting means, a pair of primary links 24 and secondary links 26 are provided. Similarly, the lift device 10 will include not only a pair of pin and slot arrangements 30 and a pair of pin and slot arrangements 38, but also a pair of pin and latch arrangements 44 and a pair of pin and latch arrangements 52, each of which is of identical construction and disposed on opposite sides of the cutout 16 in the preferred embodiment. While the components have in some instances been discussed in the singular for clarity, they are advantageously utilized in pairs on opposite sides of the cutout 16.

OPERATION

Referring to FIG. 1, the phantom lines illustrate the sewing head 12 in a storage position resting on the stop 60 with the hinged panel 14*a* in an open position. When the sewing head 12 is in the storage position, the pin 34 is in engagement with one end of the slot 32, the pin 40 is in engagement with one end of the slot 42, and the primary link 24 is in engagement with the stop 62. As the sewing machine head 12 is raised, the initial pivotal motion of the head 12, base plate 20, and secondary link 26 occurs about the pivot point or pin 28 such that the secondary link 26 pivots in a rearward (relative to the front of the cabinet 11) or clockwise direction relative to the primary link 24 by a preselected amount where the pin 34 engages the opposite end of the slot 32 (as shown in solid lines in FIG. 1). When the pin 34 has engaged the opposite end of the slot 32, further pivotal movement of the sewing head 12 occurs about the pivot point or pin 22. At this point, the center of gravity of the sewing machine head 12 has been substantially shifted toward the pin 22 and a major portion of the weight of the sewing machine head 12 is supported in near vertical alignment by the pins 22 and 28.

Figure 2:
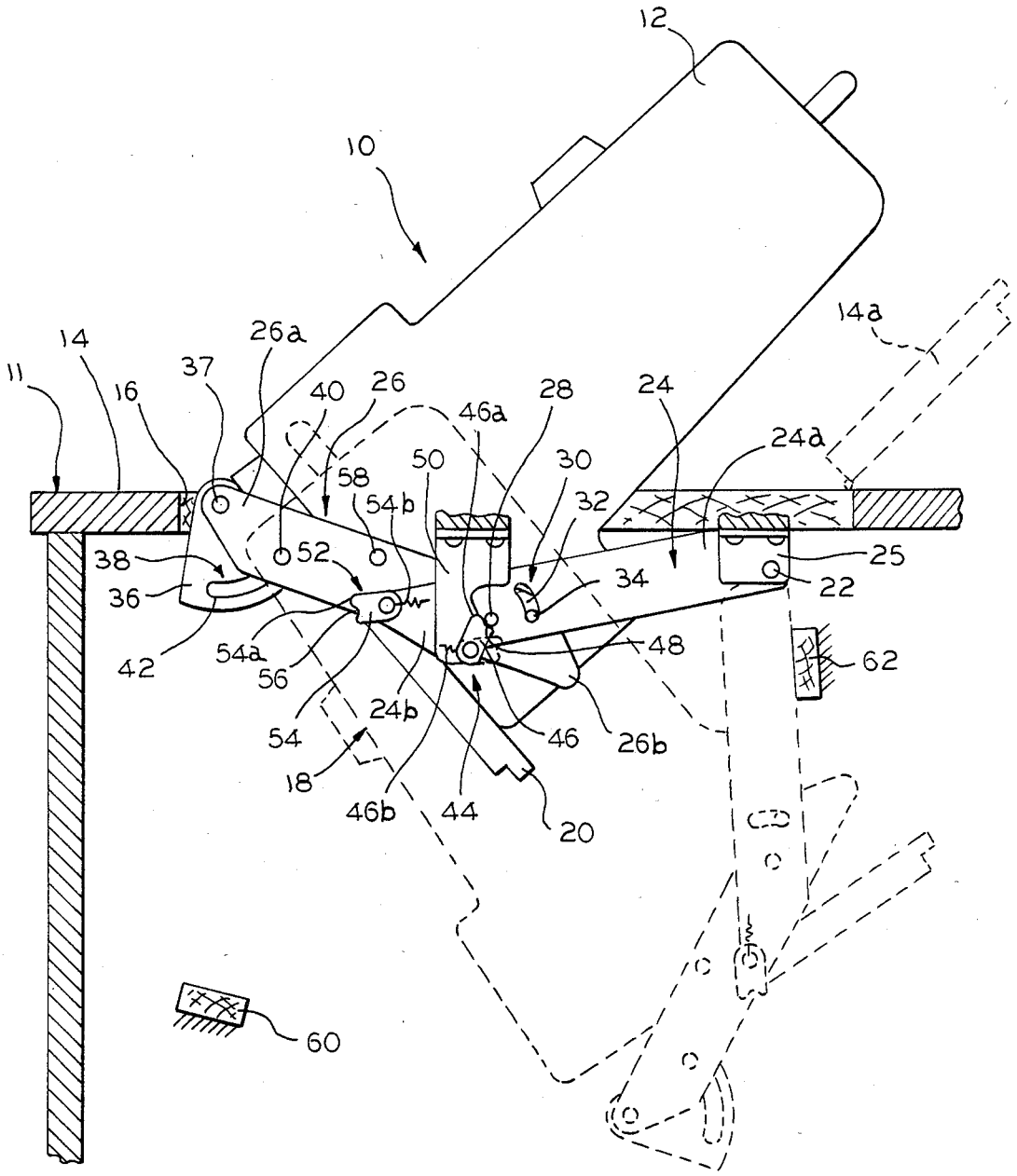
FIG. 2 is a cross sectional view of a sewing machine lift device in accordance with the present invention illustrating a sewing machine being moved to a first latch position.

Referring to FIG. 2, the solid lines illustrate that further pivotal movement of the sewing head 12 about the pin 22 causes the secondary link 26 to pivot in a rearward or clockwise direction with the primary link 24. When the secondary link 26 and the primary link 24 have been pivoted together by a preselected amount, the pin 28 which projects outwardly from the primary link 24 engages and pivotally displaces the spring biased primary latch 46 until the detent shoulder 46*a* is engaged by the pin 28 and the pin 28 is disposed in the pin receiving portion 48 due to the biasing action of spring 46*b*. With the primary latch 46 engaged by the pin 28, forward or counterclockwise pivotal movement of the sewing machine head 12 about the pin 28 causes the secondary link 26 to pivot in a forward or counterclockwise direction relative to the primary link 24. When the pin 34 again engages the one end of the slot 32 following pivotal movement of the secondary link 26 by a preselected amount, the sewing machine head 12 is in the lower or flat bed operating position and the hinged rear section or panel 14*a* is closed (as shown in solid lines in FIG. 3). In addition, it will be noted from the drawings that the pin 58 projecting from the secondary link 26 will have displaced the pivotable spring biased secondary latch 54 without engagement.

In order to lower the sewing head 12 from the lower or flat bed operating position to the storage position, the hinged panel 14*a* is opened. Next, the sewing machine head 12 is pivotally moved about the pin 28 such that the secondary link 26 pivots in a rearward or clockwise direction relative to the primary link 24 by a preselected amount where the pin 34 engages the opposite end of the slot 32 (as shown in phantom lines in FIG. 3). Then, the sewing machine head 12 is pivotally moved about the pin 22 such that the secondary link 26 is pivoted in a rearward or clockwise direction with the primary link 24 by a preselected amount where the pin 28 releases the primary latch 46 which is repositioned by the spring 46*b*. Next, the sewing head 12 is lowered toward the storage position by first pivotally moving it about the pin 22 such that the secondary link 26 is pivoted in a forward or counterclockwise direction with the primary link 24 by a preselected amount where the primary link 24 engages the stop 62 (as shown in solid lines in FIG. 1). Finally, the sewing machine head 12 is pivotally moved further about the pin 28 such that the secondary link 26 pivots in a forward or counterclockwise direction relative to the primary link 24 by a preselected amount where the pin 34 again engages the one end of the slot 32 and the head 12 is resting on the stop 60.

Figure 4:
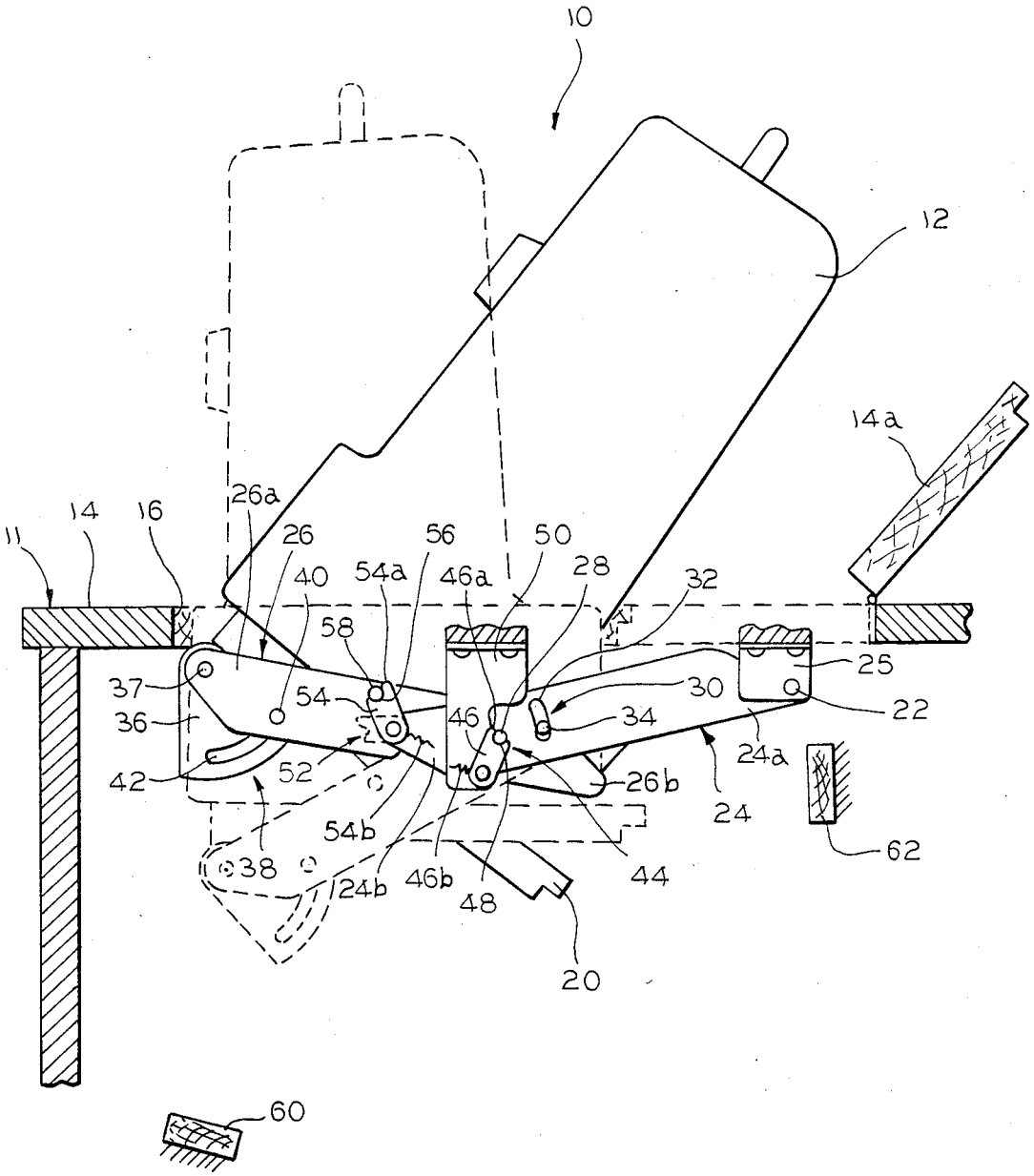
FIG. 4 is a cross sectional view of a sewing machine lift device in accordance with the present invention illustrating a sewing machine being moved to a second latch position.

However, in the event that it is desired to raise the sewing head 12 from the lower or flat bed operating position to the upper or free arm operating position, the hinged panel 14*a* is opened and the head 12 is pivotally moved about the pin 28 such that the secondary link 26 pivots in a rearward or clockwise direction relative to the primary link 24 (as shown in solid lines in FIG. 4). When the secondary link 26 has been pivoted relative to the primary link 24 by a preselected amount, the pin 58 engages and pivotally displaces the spring biased secondary latch 54 until the detent shoulder 54*a* is engaged by the pin 58 and the pin 58 is disposed in the pin receiving portion 56 due to the biasing action of the spring 54*b* (as shown in solid lines in FIG. 4). When the pin 58 is disposed in the pin receiving portion 56, the sewing head 12 is pivotally moved about the pivot point or pin 37 such that the base plate 20 is pivoted in a forward or counterclockwise direction relative to the secondary link 26 by a preselected amount with the rear portion of the base plate 20 raised above the tabletop 14 sufficiently to permit the hinged panel 14*a* to be closed. When the hinged panel 14*a* has been closed, the sewing head 12 is pivotally moved about the pin 37 such that the base plate 20 pivots in a rearward or clockwise direction relative to the secondary link 26 by a preselected amount where the edge of the base plate 20 confronting the hinged panel 14*a* rests upon and is supported by a complementary edge of the closed hinged panel 14*a* (as shown in solid lines in FIG. 5). After this has been done, the sewing head 12 is in the upper or free arm operating position with the base plate 20 disposed in the plane of the tabletop 14.

Figure 5:
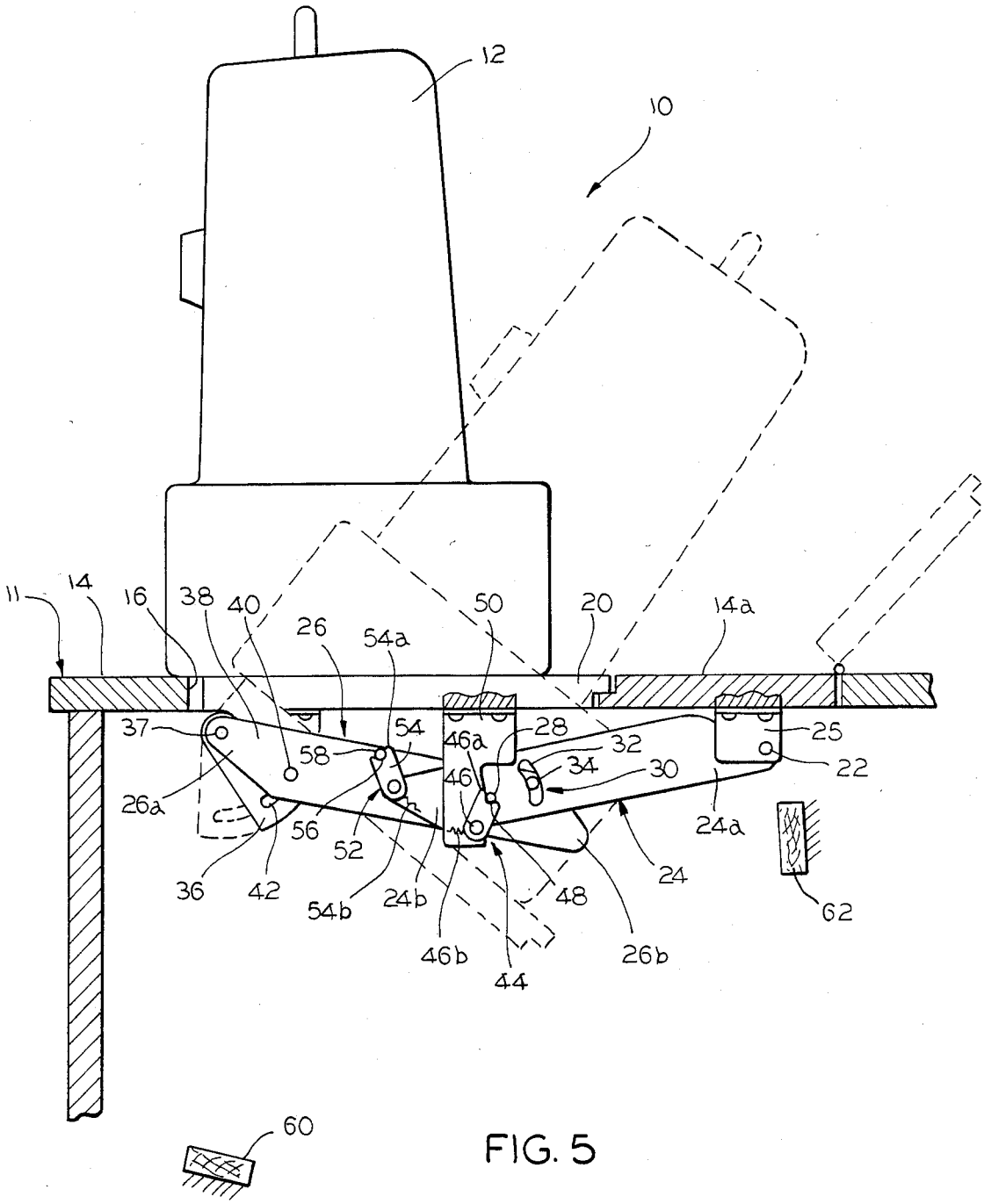
FIG. 5 is a cross sectional view of a sewing machine lift device in accordance with the present invention illustrating a sewing machine being moved to an upper operating position.
Figure 6:
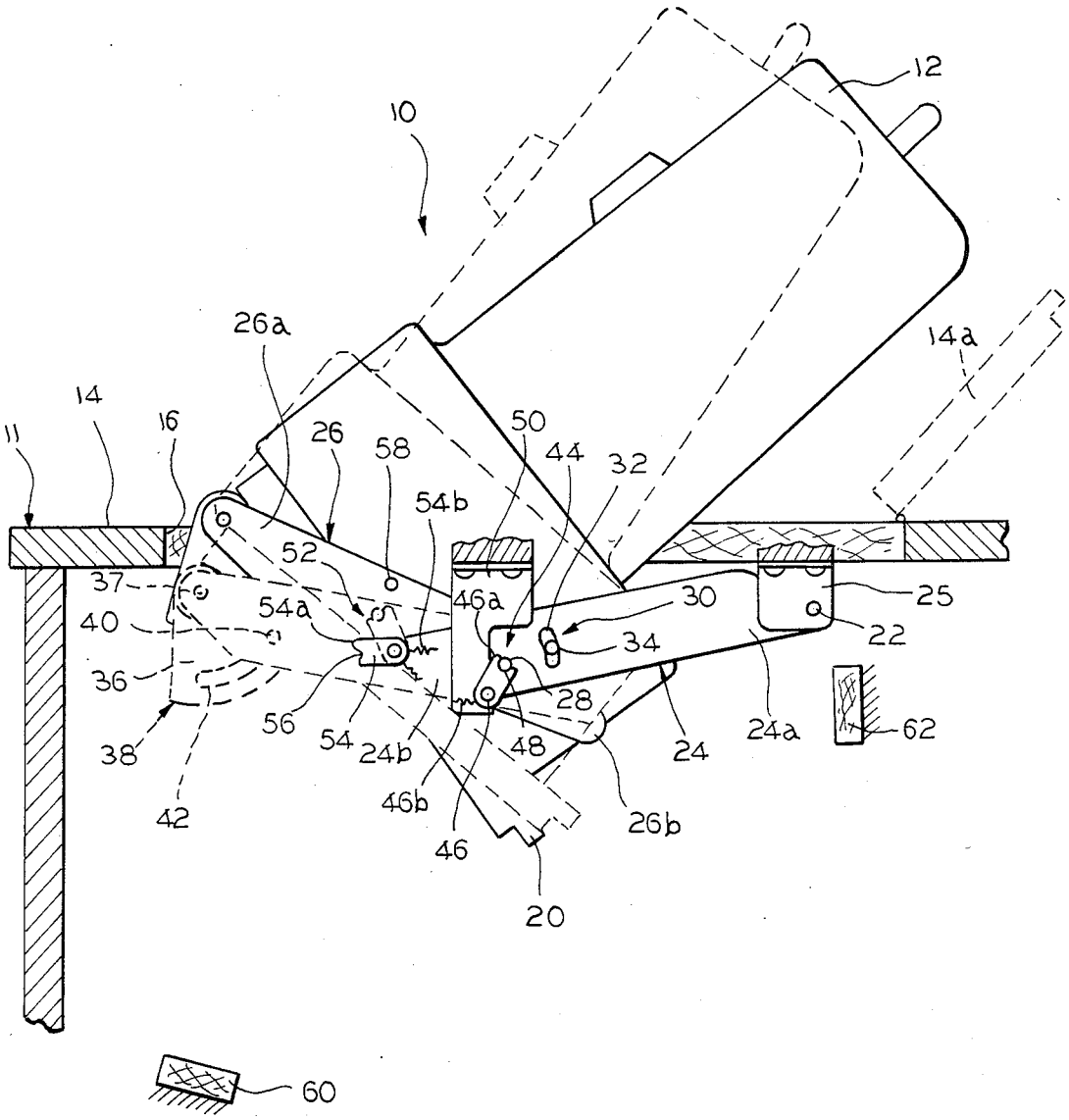
FIG. 6 is a cross sectional view of a sewing machine lift device in accordance with the present invention illustrating a sewing machine being moved to disengage from the second latch position for movement to the lower operating position.

Referring to FIGS. 5 and 6, the movement required to return the sewing head 12 from the upper or free arm operating position to the lower or flat bed operating position is illustrated. The sewing machine head 12 is initially pivotally moved about the pin 37 such that the base plate 20 is pivoted in a forward or counterclockwise direction relative to the secondary link 26 by a preselected amount sufficient to position the edge of the base plate 20 confronting the hinged panel 14*a* above the tabletop 14 such that the hinged panel 14*a* can be opened. When the hinged panel 14*a* has been opened, the sewing machine head 12 is pivotally moved about the pin 37 such that the base plate 20 is pivoted in a rearward or clockwise direction relative to the secondary link 26 by a preselected amount where the pin 40 engages the one end of the slot 42 (as shown in phantom lines in FIG. 5). At this point, further pivotal movement of the sewing head 12 occurs about the pin 28 such that the secondary link 26 is pivoted in a rearward or clockwise direction relative to the primary link 24 by a preselected amount where the pin 58 releases the secondary latch 54 which is repositioned by the spring 54*b*. When the pin 58 has released the secondary latch 54, the sewing machine head 12 is pivotally moved about the pin 28 such that the secondary link 26 pivots in a forward or counterclockwise direction relative to the primary link 24 by a preselected amount where the pin 34 engages the one end of the slot 32 at which point the sewing head 12 is in the lower or flat bed operating position (as shown in phantom lines in FIG. 4).

Figure 7:
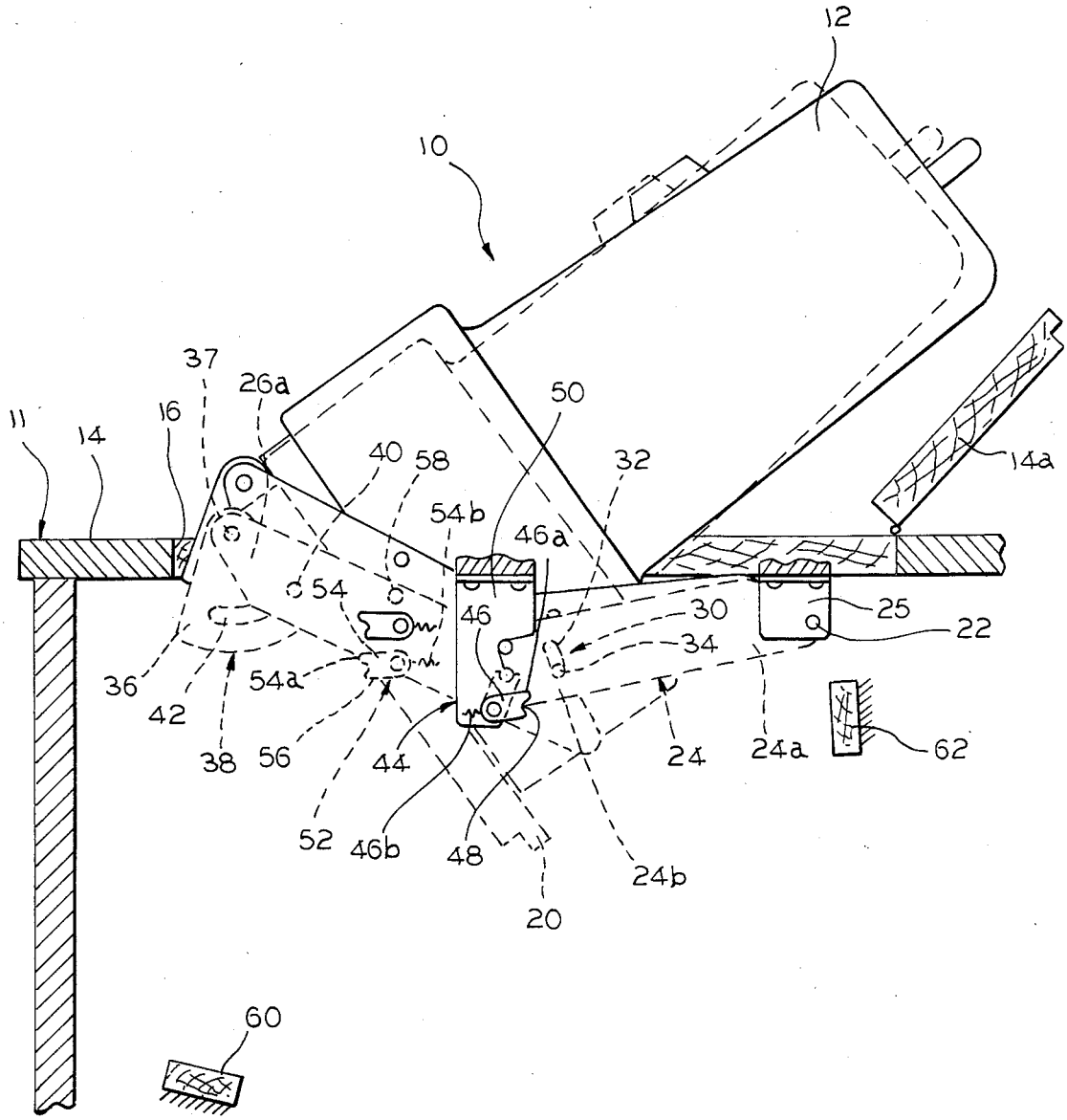
FIG. 7 is a cross sectional view of a sewing machine lift device in accordance with the present invention illustrating a sewing machine being moved to disengage from the first latch position for movement to the storage position.

If it is desired to lower the sewing head 12 from the upper or free arm operating position directly to the storage position, this can be accomplished by further pivotal movement in the rearward or clockwise direction as shown in FIG. 7. When the sewing machine head 12 is pivotally moved about the pin 28 such that the secondary link 26 is pivoted in a rearward or clockwise direction relative to the primary link 24 by a preselected amount where the secondary latch 54 is released by the pin 58, additional pivotal movement in the rearward or clockwise direction causes the pin 34 to engage the opposite end of the slot 32 and transfer the pivotal movement to the pin 22. As will be appreciated, further pivotal movement of the sewing head 12 about the pin 22 such that the secondary link 26 is pivoted in the rearward or clockwise direction with the primary link 24 by a preselected amount causes the pin 28 to release the primary latch 46 which is repositioned by the spring 46*b* after which the sewing machine head 12 is pivotally moved about the pin 22 such that the secondary link 26 is pivoted in the forward or counterclockwise direction with the primary link 24 by a preselected amount where the primary link 24 is in engagement with the stop 62. At this point, the sewing machine head 12 is pivotally moved about the pin 28 such that the secondary link 26 is pivoted in a forward or counterclockwise direction relative to the primary link 24 by a preselected amount where the pin 34 engages the one end of the slot 32 and the head 12 is in engagement with the stop 60.

As will be appreciated from a consideration of the structure and operation of the present invention, the sewing machine lift mechanism is capable of providing two working positions, i.e., a lower or flat bed operating position and an upper or free arm operating position, both of which are near the front of the cabinet. The lift mechanism also inherently shifts the sewing machine center of gravity closer to the pivot point whereby the force required to move the sewing machine between the various positions is greatly reduced without the need for spring assistance or counterbalances. Moreover, the sewing machine head can be simply and conveniently shifted between the various positions from a seated operating position with the utilization of relatively simple mechanical structure representing a significant advancement in multiple position sewing machine cabinet lift devices.

Variations of the details herein given may be made by those skilled in the art without departing from the spirit and scope of the present invention as defined by the appended claims.

We claim:

1. A sewing machine lift device to alternately provide flat bed, free arm and storage positions for a sewing machine head of the type having a free arm, comprising:

a pivoting lift mechanism adapted to be disposed beneath a cutout in a tabletop of a cabinet;

a base for said sewing machine head secured to said pivoting lift mechanism to permit movement of said sewing machine head between said flat bed, free arm and storage positions;

said pivoting lift mechanism including means for shifting the center of gravity of said sewing machine head toward a primary pivot point, said shifting means including primary pivot means adapted to be pivotally secured to the underside of said tabletop at said primary pivot point and secondary pivot means pivotally secured at said base with said primary pivot means being pivotally secured to said secondary pivot means, said pivoting lift mechanism also including means for limiting relative pivotal movement between said primary pivot means and said secondary pivot means and between said secondary pivot means and said base; and means for supporting said sewing machine head in each of said flat bed, free arm and storage positions.

2. The sewing machine lift device as defined by claim 1 wherein said secondary pivot means is adapted to be pivoted in one direction relative to said primary pivot means by a preselected amount, said means for limiting relative pivotal movement between said primary and secondary pivot means engaging in one direction when said secondary pivot means has been pivoted in the one direction by said preselected amount, said secondary pivot means then being adapted to be pivoted in the one direction together with said primary pivot means by a preselected amount, said means for supporting said sewing machine head in said flat bed position being engaged when said secondary pivot means has been pivoted in the one direction together with said primary pivot means by said preselected amount, said secondary pivot means then being adapted to be pivoted in the opposite direction relative to said primary pivot means by a preselected amount, said means for limiting relative pivotal movement between said primary and secondary pivot means engaging in the opposite direction when said secondary pivot means has been pivoted in the opposite direction by said preselected amount, whereby said pivoting lift mechanism is operable to move said sewing machine head from said storage position to said flat bed position.

3. The sewing machine lift device as defined by claim 2 wherein said secondary pivot means is adapted to be pivoted from said flat bed position in the one direction relative to said primary pivot means by a preselected amount, said means for supporting said sewing machine head in said free arm position being engaged when said secondary pivot means has been pivoted from said flat bed position in the one direction by said preselected amount, said base then being adapted to be pivoted in the opposite direction relative to said secondary pivot means by a preselected amount, whereby said pivoting lift mechanism is operable to move said sewing machine head from said flat bed position to said free arm position.

4. The sewing machine lift device as defined by claim 3 wherein said tabletop includes a rear hinged section adjacent said cutout, said rear hinged section being open when moving said sewing head from said storage position to said flat bed position and when moving said sewing machine head from said flat bed position to said free arm position, said rear hinged section normally remaining closed.

5. The sewing machine lift device as defined by claim 4 wherein said preselected amount by which said base is adapted to be pivoted in the opposite direction relative to said secondary pivot means is sufficient to position the edge of said base confronting said rear hinged section above said table top such that said rear hinged section can be lowered into the plane of said tabletop after which said base is adapted to be pivoted in the one direction relative to said secondary pivot means until said base rests on said rear hinged section with said sewing machine head in said free arm position.

6. The sewing machine lift device as defined by claim 5 wherein said base is adapted to be pivoted in the opposite direction by said preselected amount sufficient to position the edge of said base confronting said rear hinged section above said tabletop such that said rear hinged section can be opened while lowering said sewing machine head from said free arm position.

7. The sewing machine lift device as defined by claim 6 wherein said base is adapted to be pivoted in the one direction relative to said secondary pivot means by a preselected amount after said rear hinged section has been opened, said means for limiting relative pivotal movement between said secondary pivot means and said base engaging in one direction when said base has been pivoted in the one direction by said preselected amount, said secondary pivot means then being adapted to be pivoted in the one direction relative to said primary pivot means by a preselected amount, said means for supporting said sewing machine head in said free arm position being released when said secondary pivot means has been pivoted in the one direction by said preselected amount, said secondary pivot means then being adapted to be pivoted in the other direction relative to said primary pivot means by a preselected amount, said means for limiting relative pivotal movement between said primary and secondary pivot means engaging in the opposite direction when said secondary pivot means has been pivoted in the opposite direction by said preselected amount after which said rear hinged section can be closed, whereby said pivoting lift mechanism is operable to move said sewing machine head from said free arm position to said flat bed position.

8. The sewing machine lift device as defined by claim 7 wherein said secondary pivot means is adapted to be pivoted in the one direction relative to said primary pivot means by a preselected amount after said rear hinged section has been opened, said means for limiting relative pivotal movement between said primary and secondary pivot means engaging in the one direction when said secondary pivot means has been pivoted in the one direction by said preselected amount, said secondary pivot means then being adapted to be pivoted in the one direction together with said primary pivot means by a preselected amount, said means for supporting said sewing machine head in said flat bed position being released when said secondary pivot means has been pivoted in the one direction together with said primary pivot means by said preselected amount, said secondary pivot means then being adapted to be pivoted in the opposite direction together with said primary pivot means until said primary pivot means engages stop means for limiting pivotal movement of said primary pivot means in the opposite direction, said secondary pivot means then being adapted to be pivoted in the opposite direction relative to said primary pivot means by a preselected amount, said means for limiting relative pivotal movement between said primary and secondary pivot means engaging in the opposite direction when said secondary pivot means has been pivoted in the opposite direction by said preselected amount, whereby said pivoting lift mechanism is operable to move said sewing machine head from said flat bed position to said storage position.

9. The sewing machine lift device as defined by claim 6 wherein said base is adapted to be pivoted in the one direction relative to said primary pivot means by a preselected amount after said rear hinged section has been opened, said means for limiting relative pivotal movement between said base and said secondary pivot means engaging in one direction when said base has been pivoted in the one direction by said preselected amount, said secondary pivot means then being adapted to be pivoted in the one direction relative to said primary pivot means by a preselected amount, said means for limiting relative pivotal movement between said primary and secondary pivot means engaging in the one direction when said secondary pivot means has been pivoted in the one direction by said preselected amount, said secondary pivot means then being adapted to be pivoted in the one direction together with said primary pivot means by a preselected amount, said means for supporting said sewing machine in said free arm and flat bed positions being released when said secondary pivot means has been pivoted in the one direction together with said primary pivot means by said preselected amount, said secondary pivot means then being adapted to be pivoted in the opposite direction together with said primary pivot means until said primary pivot means engages stop means for limiting pivotal movement of said primary pivot means in the opposite direction, said secondary pivot means then being adapted to be pivoted in the opposite direction relative to said primary pivot means by a preselected amount, said means for limiting relative pivotal movement between said primary and secondary pivot means engaging in the opposite direction when said secondary pivot means has been pivoted in the opposite direction by said preselected amount, whereby said pivoting lift mechanism is operable to move said sewing machine head from said free arm position directly to said storage position.

10. The sewing machine lift device as defined by claim 1 wherein said means for supporting said sewing machine head in said storge position includes stop means adapted to support said sewing machine head at a point remote from said base.

11. A sewing machine lift device to alternately provide flat bed, free arm and storage positions for a sewing machine head of the type having a free arm, comprising:

a pivoting lift mechanism adapted to be disposed beneath a cutout in a tabletop of a cabinet;

a base plate on which said sewing machine head is to be mounted, said base plate being secured to said pivoting lift mechanism to permit movement of said sewing machine head between said flat bed, free arm and storage positions, said base plate being disposed in the plane of said tabletop when said sewing machine head is in said free arm position;

said pivoting lift mechanism including means for shifting the center of gravity of said sewing machine head toward a primary pivot point, said shifting means including a pair of primary links having first ends pivotally secured to the underside of said tabletop adjacent and on opposite sides of said cutout at said primary pivot point and a pair of secondary links having first ends pivotally secured at opposite sides of said base plate remote from the points at which said primary links are secured to said tabletop and the second ends of said primary links being pivotally secured to the second ends of said secondary links, said pivoting lift mechanism also including means for limiting relative pivotal movement between said primary links and said secondary links and between said secondary links and said base plate; and means for supporting said sewing machine head in each of said flat bed, free arm and storage positions.

12. The sewing machine lift device as defined by claim 11 wherein said means for limiting relative pivotal movement between said primary links and said secondary links is a pin and slot arrangement.

13. The sewing machine lift device as defined by claim 12 wherein said pin and slot arrangement includes a curved slot with a pin disposed therein, the length of said curved slot determining the limits for relative pivotal movement.

14. The sewing machine lift device as defined by claim 13 wheren said pin is provided on one of said primary and secondary links on one side of said cutout and said curved slot is provided in the other of said primary and secondary links on the same side of said cutout.

15. The sewing machine lift device as defined by claim 14 wherein said pin is provided on said secondary link and said curved slot is provided in said primary link.

16. The sewing machine lift device as defined by claim 11 wherein said means for limiting relative pivotal movement between said secondary links and said base plate is a pin and slot arrangement.

17. The sewing machine lift device as defined by claim 16 wherein said pin and slot arrangement includes a curved slot with a pin disposed therein, the length of said curved slot determining the limits for relative pivotal movement.

18. The sewing machine lift device as defined by claim 17 wherein said base plate is provided with a pair of base brackets on opposite sides thereof, said secondary links having said first ends pivotally secured to said base brackets.

19. The sewing machine lift device as defined by claim 18 wherein said pin is provided on one of said secondary link and base bracket on one side of said cutout and said curved slot is provided in the other of said secondary link and base bracket on the same side of said cutout.

20. The sewing machine lift device as defined by claim 19 wherein said pin is provided on said secondary link and said curved slot is provided in said base bracket.

21. The sewing machine lift device as defined by claim 11 wherein said means for supporting said sewing machine head in said flat bed position includes a pin and latch arrangement.

22. The sewing machine lift device as defined by claim 21 wherein said pin and latch arrangement includes a pivotable spring biased primary latch having a pin receiving portion, said sewing machine head being supported in said flat bed position when said pin is disposed in said pin receiving portion of said primary latch.

23. The sewing machine lift device as defined by claim 22 wherein said primary latch is provided on a mounting bracket on the underside of said tabletop, said mounting bracket being disposed on one side of said cutout adjacent said primary and secondary links, said pin being provided on said primary link for engagement with said primary latch.

24. The sewing machine lift device as defined by claim 11 wherein said means for supporting said sewing machine head in said free arm position includes a pair of pin and latch arrangements.

25. The sewing machine lift device as defined by claim 24 wherein said pin and latch arrangements include a pivotable spring biased primary latch and a pivotable spring biased secondary latch, said primary and secondary latches each having a pin receiving portion, said pins being adapted to be disposed in said pin receiving portions of said primary and secondary latches.

26. The sewing machine lift device as defined by claim 25 wherein said primary latch is provided on a mounting bracket on the underside of said table, said mounting bracket being disposed on one side of said cutout adjacent said primary and secondary links, the corresponding one of said pins being provided on said primary link for engagement with said primary latch.

27. The sewing machine lift device as defined by claim 26 wherein said secondary latch is provided on said primary link and the corresponding one of said pins is provided on said secondary link, said sewing machine head being supported in said free arm position when said pins are disposed in said pin receiving portions of said primary and secondary latches.

28. The sewing machine lift device as defined by claim 11 wherein said means for supporting said sewing machine head in said storage position is a stop disposed beneath said cutout.

29. The sewing machine lift device as defined by claim 28 wherein said stop is a rigidly mounted block to support said sewing machine head at a point remote from said base plate.

30. The sewing machine lift device as defined by claim 11 including a stop disposed beneath said cutout to limit pivotal movement of said primary link in one direction, said stop being a rigidly mounted block, said primary link engaging said block when said sewing machine head is moved to said storage position.

* * * * *